US006857923B2

(12) United States Patent
Yamada et al.

(10) Patent No.: US 6,857,923 B2
(45) Date of Patent: Feb. 22, 2005

(54) METHOD OF FORMING PHOSPHOR LAYER OF GAS DISCHARGE TUBE

(75) Inventors: Hitoshi Yamada, Kawasaki (JP); Akira Tokai, Kawasaki (JP); Manabu Ishimoto, Kawasaki (JP); Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 145 days.

(21) Appl. No.: 10/100,146

(22) Filed: Mar. 19, 2002

(65) Prior Publication Data

US 2003/0049990 A1 Mar. 13, 2003

(30) Foreign Application Priority Data

Sep. 12, 2001 (JP) ..... 2001-276962

(51) Int. Cl.[7] ..... H01J 9/00
(52) U.S. Cl. ..... 445/24
(58) Field of Search ..... 445/24, 25, 50, 445/51; 313/488

(56) References Cited

U.S. PATENT DOCUMENTS 4,363,997 A * 12/1982 Kodama ..... 313/487
5,514,932 A * 5/1996 Willibrordus et al. ..... 313/489

* cited by examiner

*Primary Examiner*—Sandra O'Shea
*Assistant Examiner*—Sumati Krishnan
(74) *Attorney, Agent, or Firm*—Staas & Halsey LLP

(57) ABSTRACT

A method of forming a phosphor layer of a gas discharge tube provided with the phosphor layer on an internal surface of an elongated tubular vessel forming a discharge space. The method includes the steps of introducing a slurry of phosphor powder and a binding resin dispersed in a medium into the tubular vessel, holding the tubular vessel sideways to deposit the phosphor powder and the binding resin in the tubular vessel, and removing the medium from the tubular vessel, thereby forming a phosphor layer on one side of the internal surface of the tubular vessel.

16 Claims, 18 Drawing Sheets

PUT STATIONARILY

EXTRACT A SLURRY SOLVENT 8
1
7

7
PUT STATIONARILY

EXTRACT A SOLUTION

9

METHOD OF FORMING PHOSPHOR LAYER OF GAS DISCHARGE TUBE

CROSS-REFERENCE TO RELATED APPLICATION

This application is related to Japanese application No. 2001-276962 filed on Sep. 12, 2001, whose priority is claimed under 35 USC § 119, the disclosure of which is incorporated by reference in its entirety.

BACKGROUND OF THE INVENTION

1. Field of the Invention

The present invention relates to a method of forming a phosphor (fluorescent) layer of a gas discharge tube, and more particularly to a method of forming a phosphor layer of an elongated gas discharge tube having a diameter of approximately 0.5 to 5 mm.

2. Description of the Related Art

In a gas discharge tube such as a conventional fluorescent lamp, a phosphor layer is formed on an internal surface of the gas discharge tube by coating the internal surface of the gas discharge tube with a phosphor slurry (a coating liquid containing phosphor powder) and then drying and burning. Accordingly, the phosphor layer is uniformly formed on the internal surface of the tube. For this reason, light is emitted equally in all radial directions of the tube.

There has been known a display device in which a plurality of elongated gas discharge tubes are arranged in parallel to display images. In such a display device, a large number of discharge electrodes are provided on internal or external surfaces of the gas discharge tubes, and discharge is generated by the discharge electrodes in desired sites in the gas discharge tubes and is converted into visible light with phosphors, thereby carrying out display.

However, in the case where phosphor layers are uniformly formed on the internal surfaces of the gas discharge tubes of this display device, the phosphor layers are present on the discharge electrodes. If the phosphor layers are thus present on the discharge electrodes, the phosphors are rapidly deteriorated by the discharge. Moreover, even if electron emission layers having the effect of dropping a breakdown voltage are formed on the internal surfaces of the tubes, the phosphor layers cover the electron emission layers. Therefore, discharge characteristics are less improved and a light emission efficiency is reduced.

In addition, in the case where the phosphor layers are uniformly formed on the internal surfaces of the tubes, the visible light is emitted equally. Therefore, the efficiency of taking out emitted light toward a front surface of a screen is poor. Moreover, the expansion of discharge causes apparent expansion of pixels, which affects adjacent pixels and consequently deteriorates quality of images. Furthermore, there is a problem in that a discharge interference is caused between adjacent pixels.

Accordingly, it is desirable that the phosphor layers formed on the internal surfaces of the gas discharge tubes used in the display device should not be present on the discharge electrodes but should be formed only in positions convenient for taking out the emitted light to the front surface of the screen. However, it is hard to form the phosphor layer partially on the internal surface of an elongated gas discharge tube having a diameter of 2 mm or less and a length of 300 mm or more. Accordingly, a method of partially forming the phosphor layer has been desired.

SUMMARY OF THE INVENTION

In consideration of such circumstances, it is an object of the present invention to form a phosphor layer partially on the internal surface of an elongated gas discharge tube, thereby increasing the light emission efficiency, enhancing quality of images and prolonging the lifetime of a display device using the gas discharge tube.

The present invention provides a method of forming a phosphor layer of a gas discharge tube provided with the phosphor layer on an internal surface of an elongated tubular vessel forming a discharge space, comprising the steps of: introducing a slurry of a phosphor powder and a binding resin dispersed in a medium into the tubular vessel; holding the tubular vessel sideways to deposit the phosphor powder and the binding resin in the tubular vessel; and removing the medium from the tubular vessel, thereby forming a phosphor layer on one side of the internal surface of the tubular vessel.

According to the present invention, the phosphor powder and the binding resin are deposited on one side of the internal surface of the elongated tubular vessel to be the gas discharge tube, that is, a bottom surface of the tubular vessel in a sideways state and are burnt to form the phosphor layer. Consequently, it is possible to form a vacancy having no phosphor layer on the internal surface of the gas discharge tube. By forming an electrode on the vacancy, the lifetime of the phosphor layer can be increased.

The above and further objects and features of the invention will more fully be apparent from the following detailed description with accompanying drawings.

DETAILED DESCRIPTION OF THE PREFERRED EMBODIMENTS

Figure 1:
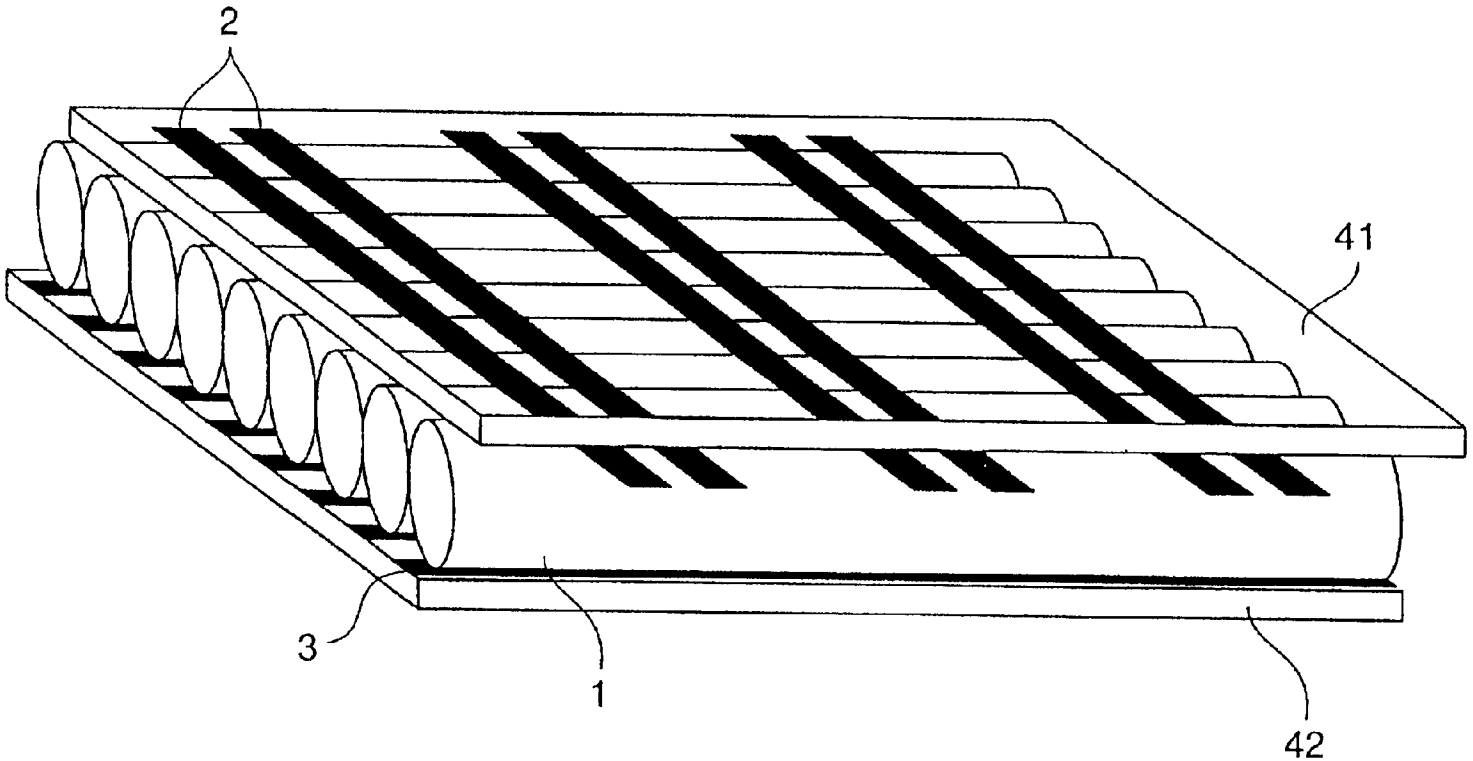
FIG. 1 is a view illustrating an example of a display device using gas discharge tubes in which phosphor layers are formed by a method according to the present invention.

The method of forming a phosphor layer of a gas discharge tube according to the present invention can be suitably used for forming a phosphor layer in an elongated gas discharge tube having a diameter of approximately 0.5 to 5 mm and a length of 300 mm or more.

In the case where the phosphor layer is to be formed on the internal surface of the tubular vessel to be a gas discharge tube, the sedimentation of phosphor powder progresses with difficulty even if a phosphor slurry is introduced into the tubular vessel for the elongated gas discharge tube. Moreover, the deposited phosphor powder is dried with difficulty because the gas discharge tube is thin.

In the present invention, therefore, the phosphor layer is formed on the internal surface of the tubular vessel by the below-described method. First of all, a slurry of the phosphor powder and a binding resin dispersed in a medium is prepared.

It is possible to use various kinds of phosphor powders for colors R, G and B which are well known. The medium may be any organic solvent capable of maintaining the phosphor powder in a dispersion state, and 1,3-dimethyl-2-imidazolidinone or the like can be used, for example.

The binding resin causes the phosphor powder to have a stickiness. The binding resin may be any resin that is soluble in water and is not soluble in a low-viscosity solvent such as acetone and may be polyvinyl alcohol, an acryl based resin or the like, for example.

The binding resin is used for binding the phosphor powder. However, if the binding resin is soluble in the medium, the slurry becomes viscous and does not pass through the tubular vessel easily. Therefore, in order to reduce the viscosity of the medium to allow the slurry to easily pass through the inside of the tubular vessel, the binding resin is used in an emulsion (colloidal dispersion) state. More specifically, the binding resin is added to the medium in a dispersion state in a dispersion medium such that it is well mixed with the phosphor powder and is then sedimented. In the case where polyvinyl alcohol is to be used as the binding resin, pure water can be used as a dispersion medium.

The binding resin may be any resin which is soluble in water and is not soluble in a low-viscosity solvent, for example, acetone as described above, but the binding resin needs to be burnt out at a temperature at which a phosphor deposited layer is to be burnt at a later step. This burning temperature is usually 450° C. or less in order to prevent deterioration of the phosphor. In this respect, accordingly, it is desirable that the polyvinyl alcohol should be used.

Next, the slurry is introduced into the tubular vessel. For the introduction, it is possible to use any tool, for example, a syringe or a pump.

Then, the tubular vessel is held sideways. It is desirable that the tubular vessel should be positioned stationarily, and horizontally, in a sideways state.

Thereafter, the phosphor powder and the binding resin are deposited in the tubular vessel. For the deposition, it is also possible to add, to the slurry, a low-viscosity solvent for promoting the deposition of the phosphor powder and the binding resin. The low-viscosity solvent is preferably added to the slurry immediately before the slurry is introduced into the tubular vessel, and the amount of addition is not particularly restricted. For the low-viscosity solvent, it is possible to use acetone, isopropyl alcohol or the like.

Subsequently, the medium and the low-viscosity solvent are removed from the tubular vessel. For example, a syringe or a pump can also be used for the removal.

After the medium and the low-viscosity solvent are removed, the phosphor powder is bound with the binding resin on one side of the internal surface of the tubular vessel, that is, a bottom, or lower, portion of the internal surface of the tubular vessel when held stationally, and horizontally, in the sideways state. When the phosphor powder is dried and then fired, therefore, the phosphor layer can be formed on one side of the internal surface of the tubular vessel.

In the method described above, in the case where the medium remains in the tubular vessel even after the medium is discharged from the tubular vessel, a low-viscosity solvent which does not dissolve the binding resin but dissolves the medium may be passed through the tubular vessel, thereby removing the medium remaining in the tubular vessel. For the low-viscosity solvent, it is also possible to use acetone, isopropyl alcohol or the like which are described above.

The above-described series of steps may be repeated plural times and a plurality of phosphor layers may be thus formed on the internal surface of the tubular vessel. In this case, if the amount of the phosphor powder in the slurry is changed, it is possible to form a plurality of phosphor layers having different thicknesses on the internal surface of the tubular vessel.

At the steps, the slurry may be introduced into the tubular vessel in a specific amount such that a convex phosphor layer can be formed in the tubular vessel. Furthermore, if air is introduced at regular intervals when the slurry is introduced into the tubular vessel, a plurality of convex phosphor layers can also be formed in the tubular vessel.

The present invention will be described below in detail based on embodiments shown in the drawings. The present invention is not restricted to the embodiments but can be variously modified.

The present invention provides a method of forming a phosphor layer in a tubular vessel to be made into a gas discharge tube. Before the explanation of the present invention, accordingly, a description will be given of an example of a display device using gas discharge tubes in which phosphor layers are formed by the method according to the present invention. In the display device, a plurality of elongated gas discharge tubes are arranged in parallel to display images. The method of forming a phosphor layer according to the present invention can be applied to various gas discharge tubes as well as the gas discharge tubes used for the above-mentioned display device.

FIG. 1 is a view illustrating an example of a display device using gas discharge tubes in which phosphor layers are formed by the method according to the present invention.

In FIG. 1, the reference numeral 41 denotes a substrate on the front side, the reference numeral 42 denotes a substrate on the rear side, the reference numeral 1 denotes a gas discharge tube, the reference numeral 2 denotes a display electrode pair (a main electrode pair), and the reference numeral 3 denotes a signal electrode (also referred to as a data electrode).

A phosphor layer is formed in the elongated gas discharge tube 1 (a discharge space) and a discharge gas is filled therein. The signal electrode 3 is formed on the substrate 42 on the rear side along the longitudinal direction of the gas discharge tube 1. The display electrode pair 2 is formed on the substrate 41 on the front side in such a direction as to cross the signal electrode 3. Adjacent electrode pairs 2 are spaced at certain intervals (non-discharge gaps), where non-discharge portions are formed.

The signal electrode 3 and the display electrode pair 2 come in close contact with outer circumferential surfaces on the lower and upper sides of the gas discharge tube 1, respectively, during assembly. The display electrode may be bonded to the gas discharge tube surface with a conductive adhesive between in order to enhance an adhesion.

In the display device as seen in a plane view, the cross portion of the signal electrode 3 and the display electrode pair 2 acts as a unit light emission region. The display is carried out by using one of the display electrode pair 2 as a scanning electrode to generate a selective discharge in the cross portion of the scanning electrode and the signal electrode 3 and thereby select a light emission region and by utilizing a wall charge formed with the light emission on the internal surface of the tube in the same region to generate a display discharge in the display electrode pair 2. The selective discharge is an opposed discharge generated in the gas discharge tube 1 between the scanning electrode and the signal electrode 3 which are opposed to each other in a vertical direction, and the display discharge is a surface discharge generated in the gas discharge tube 1 between two display electrodes provided in parallel with each other on a plane.

In the display device in which a large number of gas discharge tubes are arranged in parallel, it is also possible to employ such a structure that the display electrode and the signal electrode are previously formed like a dot and like a stripe, respectively, on the external surface of the gas discharge tube 1 by printing, evaporation or the like, electrodes for power supply are formed on the substrate 41 on the front side and on the substrate 42 on the rear side, and the electrodes for power supply are contacted with the display electrode 2 and the signal electrode 3, respectively, of the gas discharge tube 1 during assembly.

Figure 2:
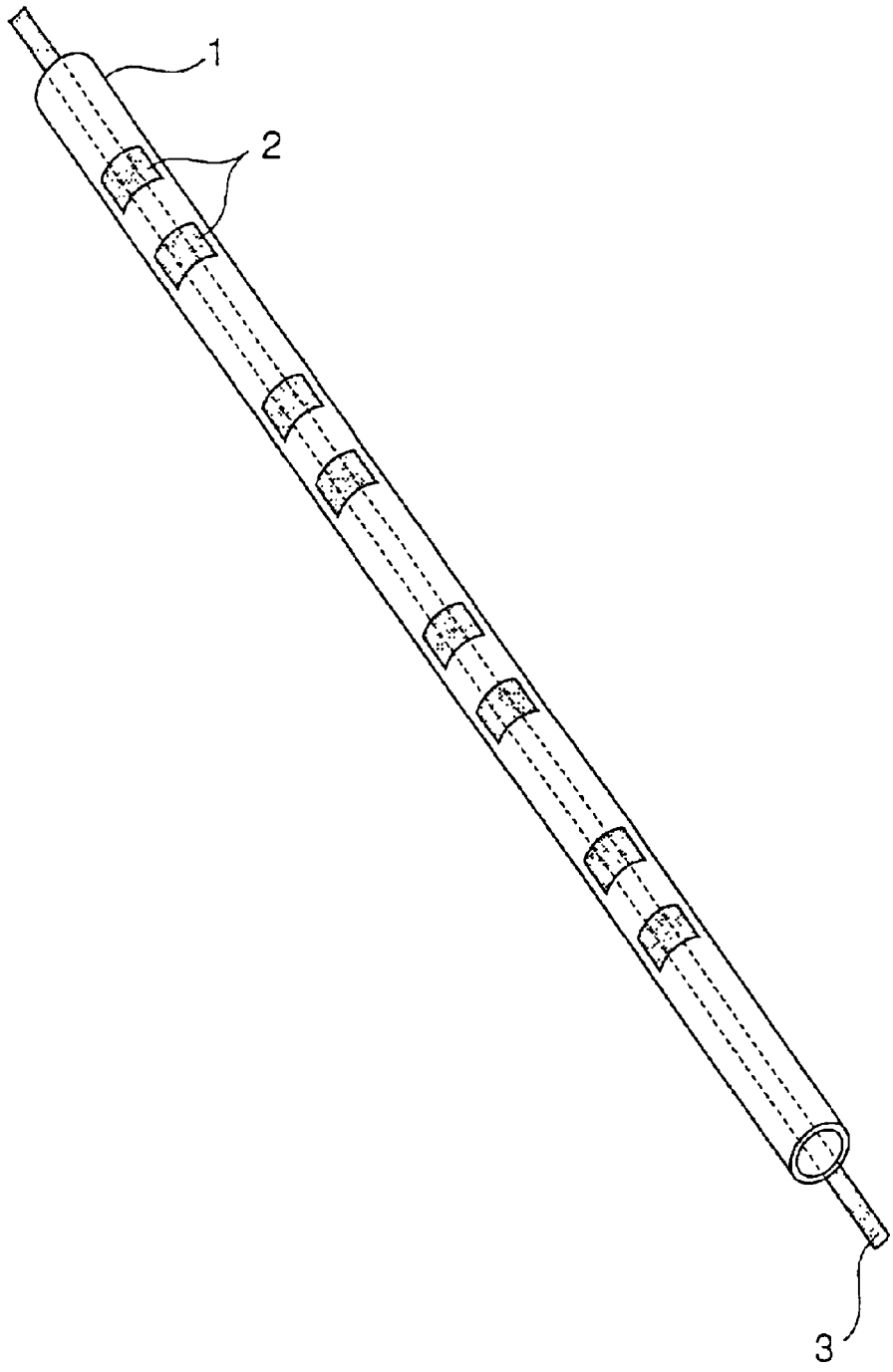
FIG. 2 is a view illustrating the structure of one gas discharge tube.
Figure 3:
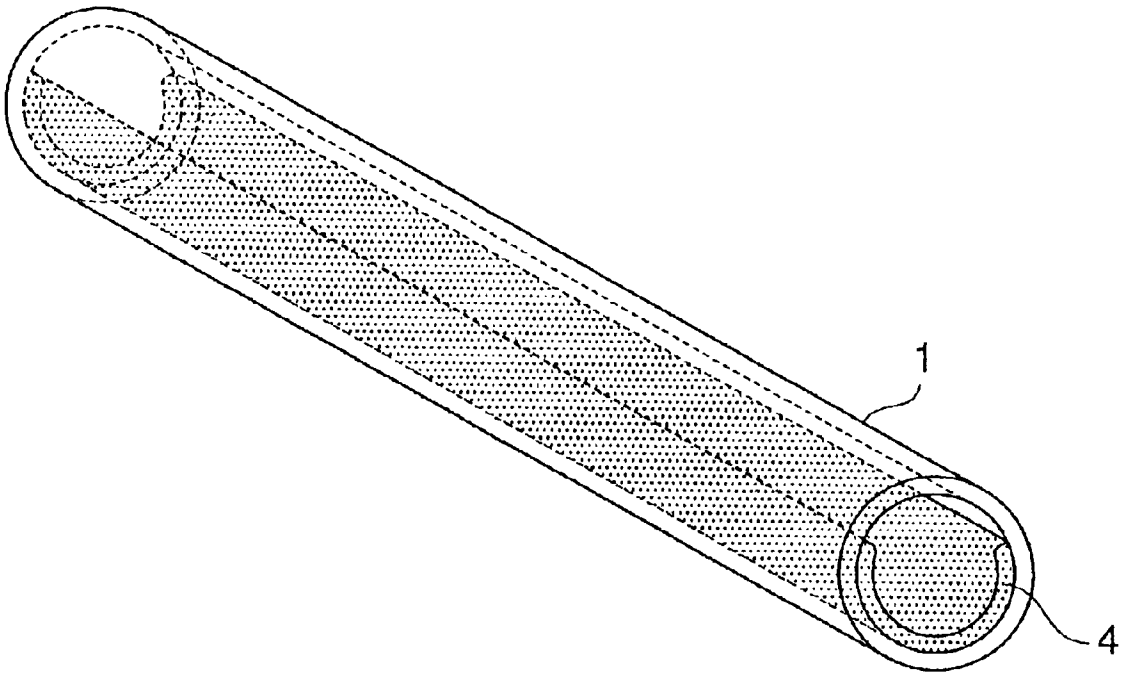
FIG. 3 is a view illustrating a phosphor layer formed in the gas discharge tube, FIGS. 4(*a*) and 4(*b*) are views illustrating the detailed structure of the gas discharge tube in FIG. 3, FIGS. 5(*a*) to 5(*d*) are views illustrating a method of forming a phosphor layer according to an embodiment of the present invention, FIGS. 6(*a*) to 6(*e*) are views illustrating a method of forming a phosphor layer according to another embodiment of the present invention.

FIG. 2 is a view illustrating the structure of one gas discharge tube and FIG. 3 is a view illustrating a phosphor layer formed in a gas discharge tube. As shown in these drawings, the display electrode pair 2 and the signal electrode 3 are formed on the gas discharge tube 1 and the phosphor layer 4 is formed in the gas discharge tube 1.

Figure 4:
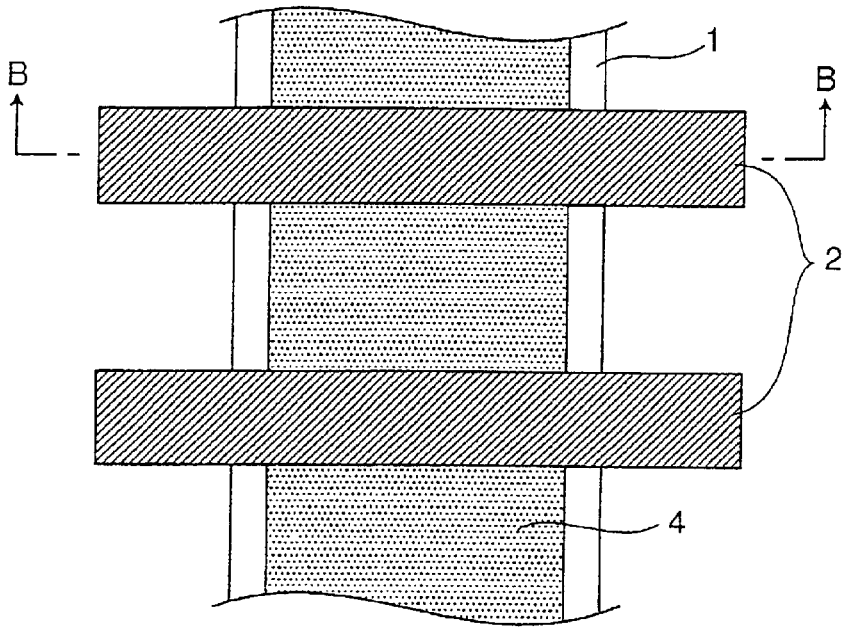
Figure 4:
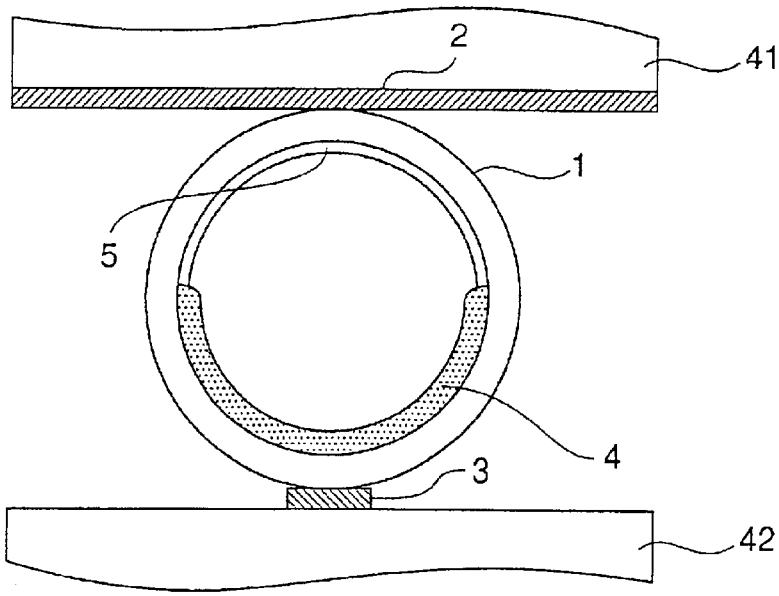

FIGS. 4(*a*) and 4(*b*) are views illustrating the detailed structure of the gas discharge tube in FIG. 3. FIG. 4(*a*) shows a partial plane of the gas discharge tube in the vicinity of the display electrode, and FIG. 4(*b*) shows a section taken along a line B—B in FIG. 4(*a*).

In these drawings, the reference numeral 5 denotes an electron emission layer of MgO. In the gas discharge tube, the phosphor layer is formed by the method of forming a phosphor layer according to the present invention which will be described below.

The gas discharge tube has such a structure that a large number of light emission points (display portions) are obtained in one tube by causing the phosphor layer to emit light by discharge of a plurality of display electrode pairs provided in contact with the external wall surface of the tube. The gas discharge tube is formed of a transparent insulator (borosilicate glass) and has a diameter of 2 mm or less and a length of 300 mm or more.

The display electrode pair 2 and the signal electrode 3 can apply a voltage to a discharge gas in the tube and a discharge is generated between a pair of display electrodes 2 in the electrode structure shown in the drawing. This electrode structure is a 3-electrode structure in which three electrodes are present per light emission site, but the invention is not limited thereto.

The electron emission layer 5 generates charged particles by collision with the discharge gas having an energy of a certain value or more. It is not necessary to always provide the electron emission layer 5.

When a voltage is applied to the display electrode pairs 2, the discharge gas filled in the tube is excited. The phosphor layer 4 emits visible light by action of vacuum ultraviolet rays generated in a de-excitation process of excited rare gas atoms.

Figure 5:
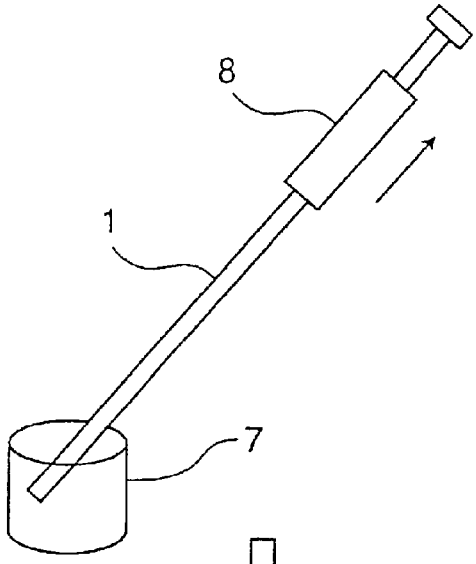
Figure 5:
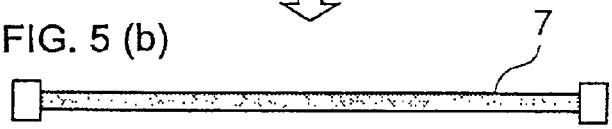
Figure 5C:
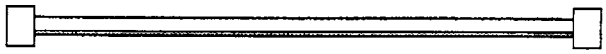
Figure 5:
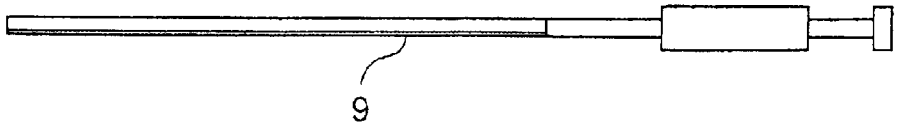

FIGS. 5(*a*) to 5(*d*) are views illustrating a method of forming a phosphor layer according to an embodiment of the present invention.

In FIGS. 5(*a*) to 5(*d*), the reference numeral 7 denotes a phosphor slurry, the reference numeral 8 denotes a syringe and the reference numeral 9 denotes a phosphor deposited layer. The phosphor slurry 7 is obtained by adding a low-viscosity solvent for promoting the deposition of phosphor powder and a binding resin to a slurry containing phosphor powder and a binding resin dispersed in a dispersion liquid (also referred to as a slurry solvent).

Known phosphor powders of colors R, G and B are used for the phosphor powder and an organic solvent such as 1,3-dimethyl-2-imidazolidinone is used for the slurry dispersion liquid.

For the binding resin, polyvinyl alcohol is dispersed in pure water.

For the low-viscosity solvent, acetone is dispersed in an organic solvent such as 1,3-dimethyl-2-imidazolidinone.

The syringe 8 is used for introducing the phosphor slurry 7 into the tubular vessel to be the gas discharge tube 1.

In the present embodiment, the phosphor slurry 7 is introduced into the tubular vessel to be the gas discharge tube 1 (the reference numeral 1 will also denote the tubular vessel in the following description) by using the syringe 8 (see FIG. 5(*a*)), the tubular vessel 1 is stationarily put horizontally in a sideways state (see FIG. 5(*b*)), and the phosphor powder and the binding resin in the phosphor slurry 7 are sedimented and bound (see FIG. 5(*c*)).

If the drying is successively carried out, a resin film is formed on a gas-liquid interface in the tubular vessel 1 because the diameter of the tubular vessel 1 is very small. Therefore, there is caused such a phenomenon that the drying does not progress. Accordingly, the slurry dispersion liquid is extracted from the tubular vessel 1 (see FIG. 5(*d*)), and thereby, water is removed to form the phosphor deposited layer 9 at one side (a lower portion) on the inner wall surface of the tubular vessel 1.

In the step described above, since the low-viscosity solvent reacts to promote the sedimentation of the phosphor powder and the binding resin, immediately after it is added to the phosphor slurry 7, the phosphor slurry 7 is added immediately before the phosphor slurry 7 is introduced into the tubular vessel 1. In order to extend the reaction over the whole system, the solvent having a low viscosity is diluted in a solvent such as 1,3-dimethyl-2-imidazolidinone in a proportion of 1:1.

After the phosphor deposited layer 9 is formed, the phosphor deposited layer 9 is dried and fired to form a phosphor layer. The phosphor deposited layer 9 may be dried by introducing dried air into the tubular vessel. When firing the phosphor deposited layer 9, oxygen is not sufficiently supplied into the tubular vessel because the inside diameter of the tubular vessel is small. For this reason, the firing is carried out while introducing air into the tubular vessel. If contaminated gas is extracted by using the same equipment immediately after the firing and a discharge gas is introduced, followed by sealing the tubular vessel, the heating step of extracting the contaminated gas is not required.

Figure 6:
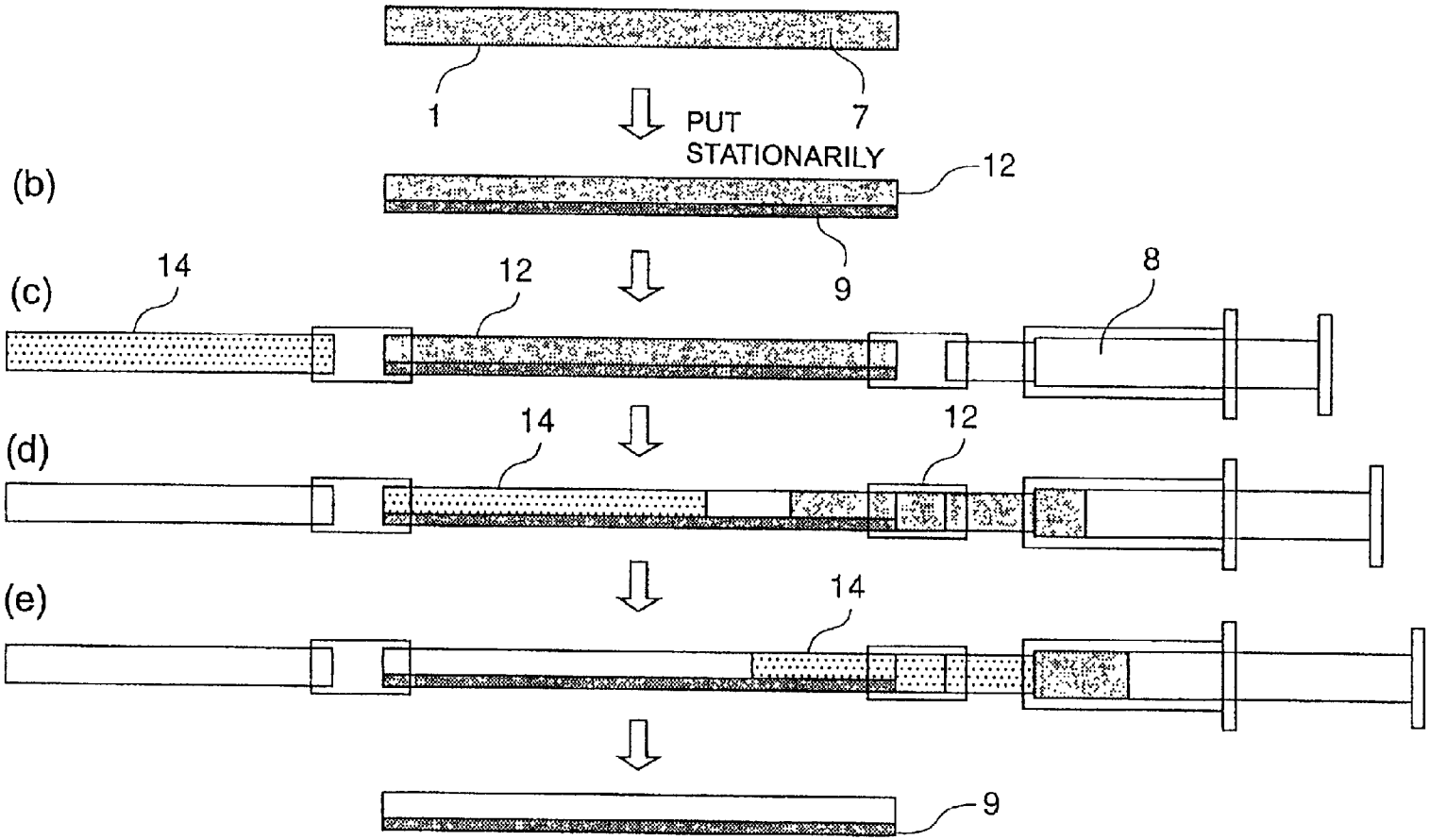

FIGS. 6(*a*) to 6(*e*) are views illustrating a method of forming a phosphor layer according to another embodiment of the present invention.

In FIGS. 6(*a*) to 6(*e*), the reference numeral 12 denotes a slurry dispersion liquid and the reference numeral 14 denotes a low-viscosity solvent. The same phosphor slurry 7 as that shown in FIGS. 5(*a*) to 5(*d*) is used. The low-viscosity solvent 14 does not dissolve a resin component contained in the phosphor slurry 7 but dissolves the slurry dispersion liquid 12 and has a viscosity coefficient of 1 mPa·s or less.

First of all, the phosphor slurry 7 is introduced into the tubular vessel 1 for the gas discharge tube and the tubular vessel 1 is stationarily put horizontally in a sideways state (see FIG. 6(*a*)). The phosphor powder and the binding resin in the phosphor slurry 7 are sedimented and bound to the wall of the tubular vessel 1.

Consequently, the phosphor slurry 7 is separated into the phosphor deposited layer 9 portion and the slurry dispersion liquid 12 portion (see FIG. 6(*b*)). So far, the production steps are the same as those shown in FIGS. 5(*a*) to 5(*d*).

Then, the slurry dispersion liquid 12 is extracted by means of the syringe 8. In the extraction, if the viscosity of the slurry dispersion liquid 12 is high or the tube has a length of 500 mm or more, the slurry dispersion liquid sticking to the inner wall of the tube is aggregated to form a pool. In a subsequent drying step, the phosphor powder bound in the vicinity of the pool is apt to be blown up by liquid convection and be scattered.

When the slurry dispersion liquid 12 is extracted, a low-viscosity solvent 14 such as acetone is passed through the tubular vessel 1 from the reverse side of the tubular vessel 1 (see FIGS. 6(*c*), 6(*d*) and (*e*).

Consequently, the slurry dispersion liquid 12 remaining in the tubular vessel 1 is dissolved and removed from the tubular vessel 1.

Figure 7:
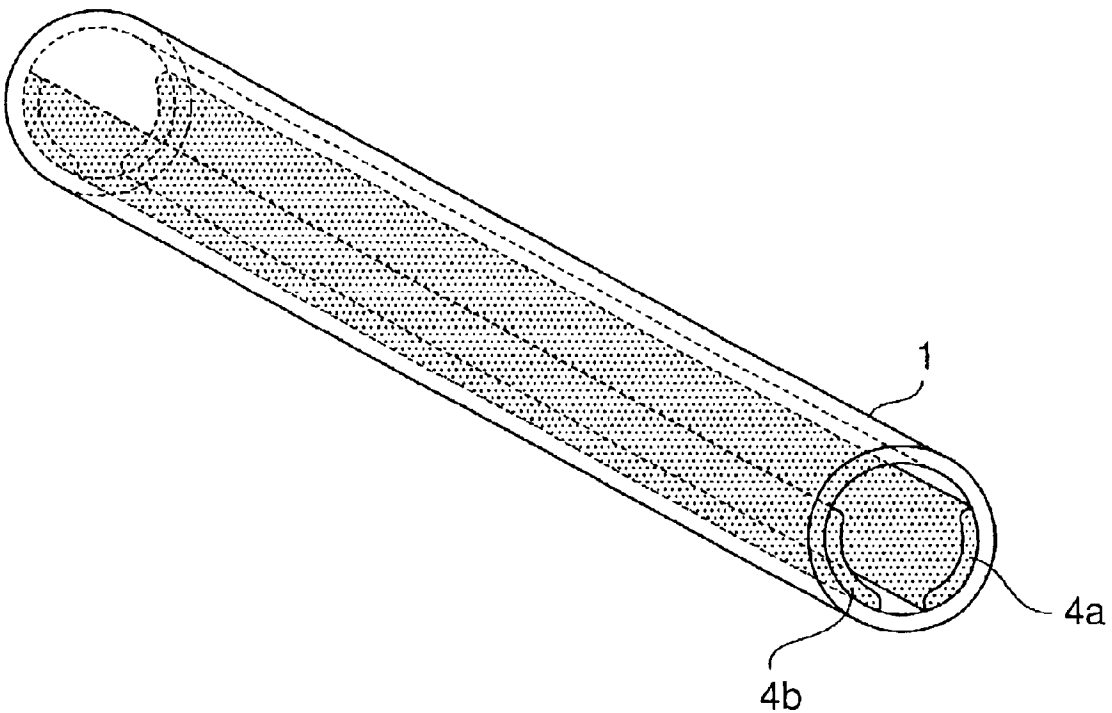
FIG. 7 is a view illustrating the structure of a gas discharge tube having phosphor layers formed in two portions, FIGS. 8(*a*) and 8(*b*) are views illustrating the detailed structure of the gas discharge tube in FIG. 7.

FIG. 7 is a view illustrating the structure of a gas discharge tube having two phosphor layers formed in two portions. As shown in FIG. 7, the phosphor layer may also be formed to be a first phosphor layer 4*a* and a second phosphor layer 4*b* in two portions in the gas discharge tube 1.

Figure 8:
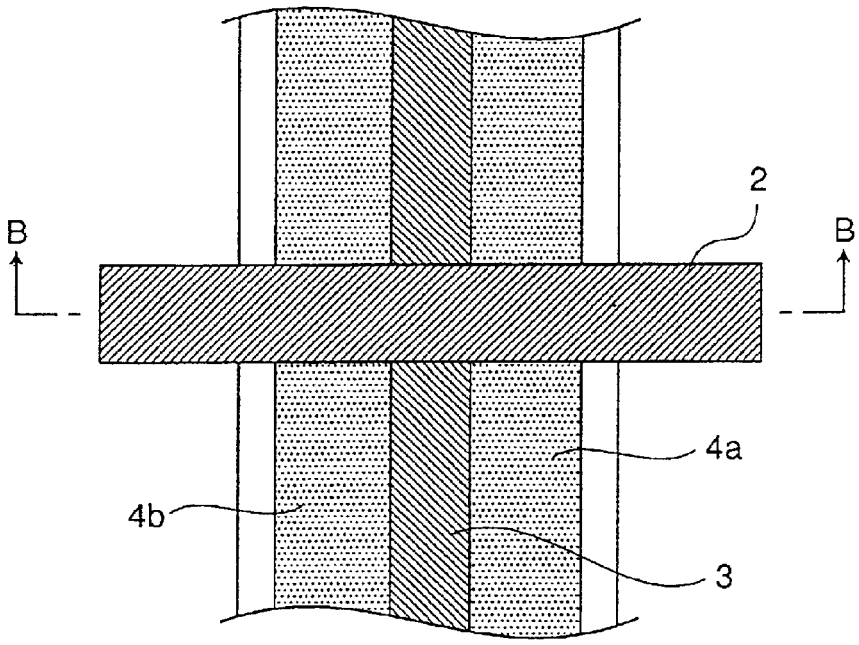
Figure 8:
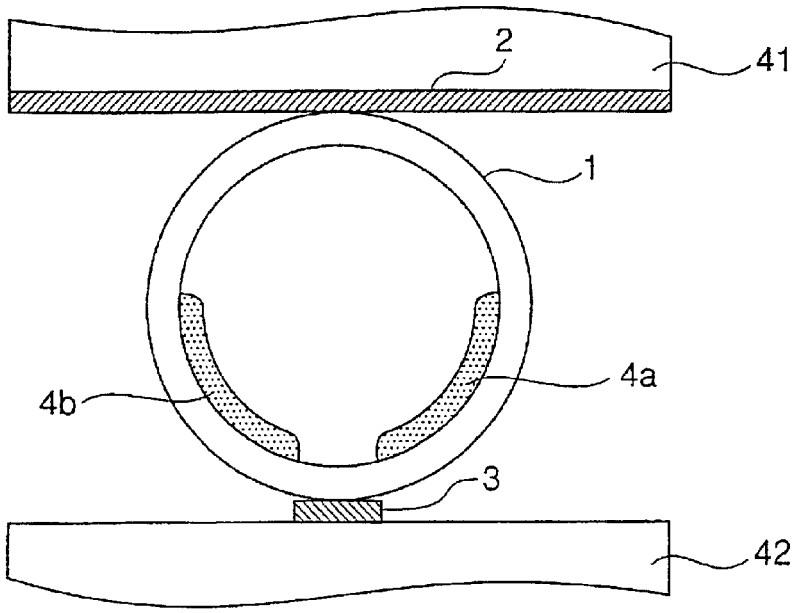

FIGS. 8(*a*) and 8(*b*) are views illustrating the detailed structure of the gas discharge tube shown in FIG. 7. FIG. 8(*a*) shows a partial plan view of the gas discharge tube in the vicinity of a display electrode and FIG. 8(*b*) shows a section taken along a line B—B in FIG. 8(*a*). These figures show a gas discharge tube having an electrode structure in which an opposed discharge is generated.

While the gas discharge tube 1 is of such a type that a light emission region is selected by the selective discharge and the display discharge (surface discharge) is generated between two display electrodes 2, the gas discharge tube shown in FIGS. 8(*a*) and 8(*b*) is of such a type that one display electrode 2 is provided, a light emission region is selected by the selective discharge and the display discharge is then generated between the display electrode 2 and the signal electrode 3. Accordingly, the phosphor layer is not formed on the opposed face of the signal electrode 3 and the display electrode 2 but is formed to be the first phosphor layer 4*a* and the second phosphor layer 4*b* in two portions. Also in the gas discharge tube, the phosphor layers are formed by the method of forming a phosphor layer according to the present invention which will be described below.

Figure 9:
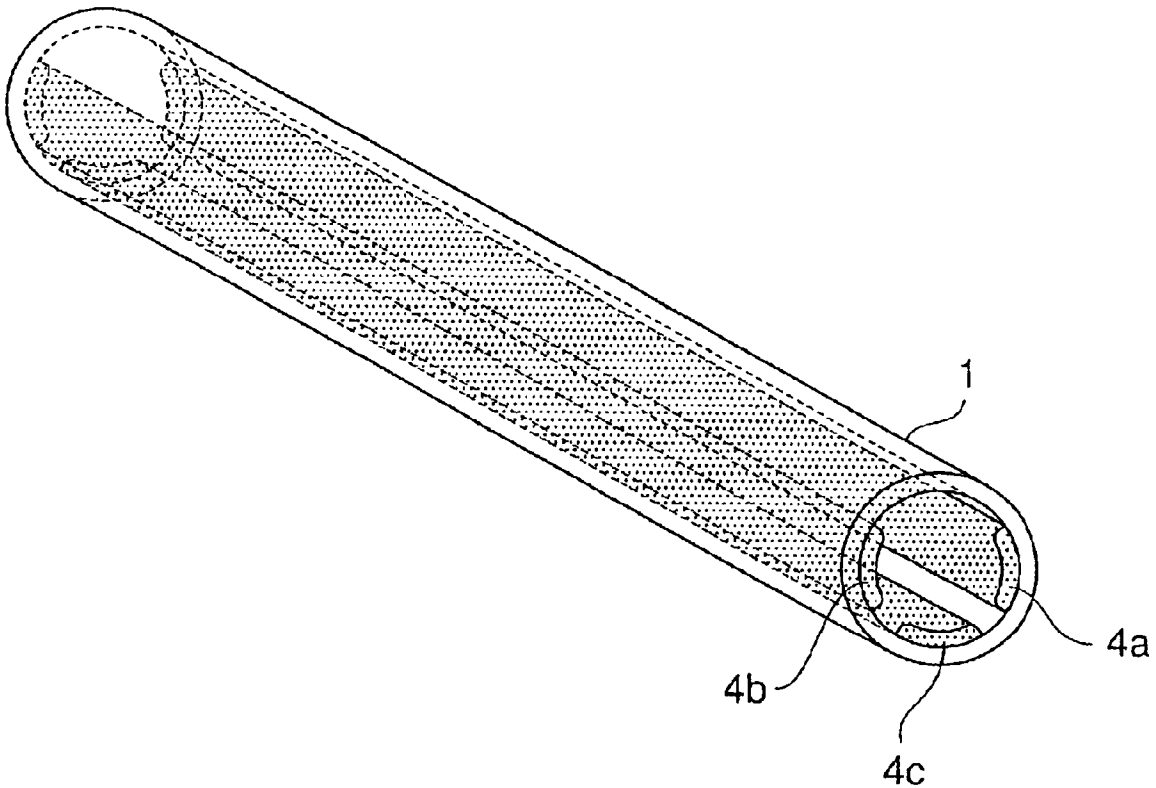
FIG. 9 is a view illustrating the structure of a gas discharge tube having phosphor layers formed in three portions, FIGS. 10(*a*) to 10(*c*) are views illustrating the detailed structure of the gas discharge tube in FIG. 9, FIGS. 11(*a*) and 11(*b*) are views illustrating the structure of a gas discharge tube in which phosphor layers are formed in two portions, and furthermore, the phosphor layers include thick phosphor layers and thin phosphor layers, FIGS. 12(*a*) to 12(*d*) are views illustrating an embodiment in which phosphor layers are formed in a plurality of portions.
Figure 10:
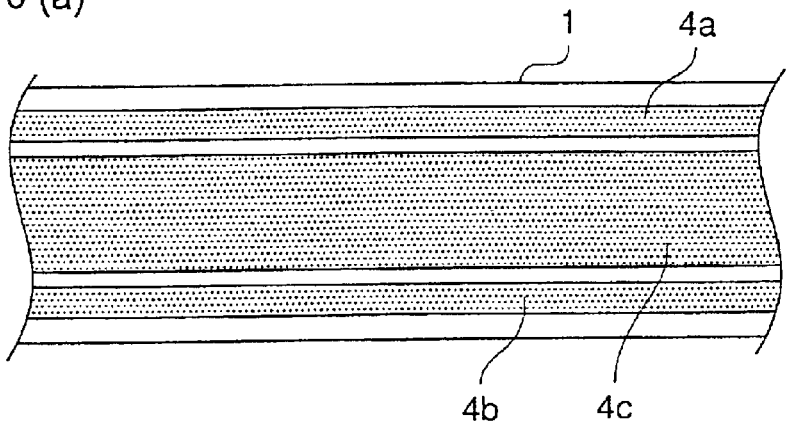
Figure 10B:
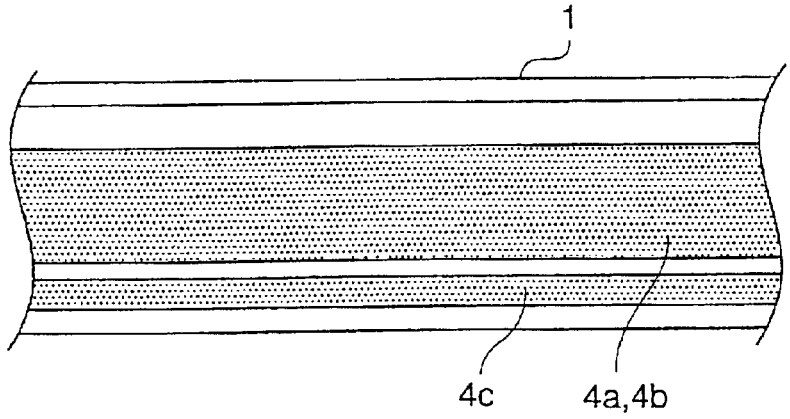
Figure 10:
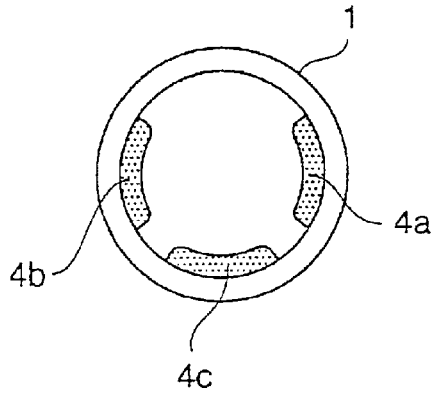

FIG. 9 is a view illustrating the structure of a gas discharge tube having three phosphor layers formed in three portions. FIGS. 10(*a*) to 10(*c*) are views illustrating the detailed structure of the gas discharge tube shown in FIG. 9. FIG. 10(*a*) shows a partial plan view, FIG. 10(*b*) shows a side view of the tube shown in FIG. 10(*a*), and FIG. 10(*c*) shows a section of the tube shown in FIG. 10(*b*). As shown in these figures, the phosphor layer can also be formed to be a first phosphor layer 4*a*, a second phosphor layer 4*b* and a third phosphor layer 4*c* in three portions in the gas discharge tube 1.

Figure 11:
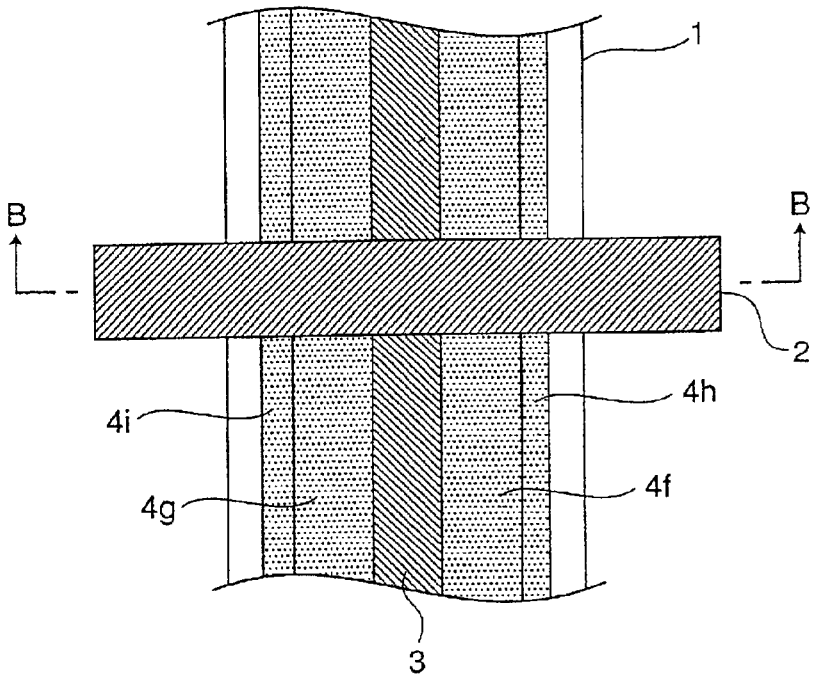
Figure 11:
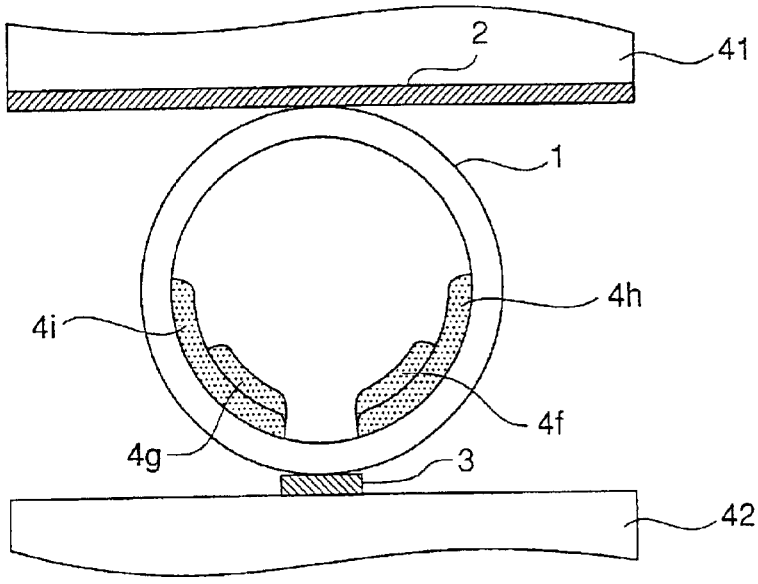

FIGS. 11(*a*) and 11(*b*) are views illustrating the structure of a gas discharge tube in which two phosphor layers are formed in two portions, and furthermore, the phosphor layers are formed in thick phosphor layers and thin phosphor layers. FIG. 11(*a*) shows a partial plan view of the gas discharge tube in the vicinity of a display electrode and FIG. 11(*b*) shows a section taken along a line B—B in FIG. 11(*a*).

In these figures, 4*f* and 4*g* denote thick phosphor layers and 4*h* and 4*i* denote thin phosphor layers. In the gas discharge tube 1, the phosphor layers are formed by a method of forming a phosphor layer in a plurality of portions which will be described below.

In such a gas discharge tube 1, vacuum ultraviolet rays generated in the gas discharge tube 1 are effectively utilized by using the thick phosphor layers 4*f* and 4*g* as reflection type phosphors and the thin phosphor layers 4*h* and 4*i* as transmission type phosphors. Thus, a high light emission efficiency can be obtained.

Figure 12:
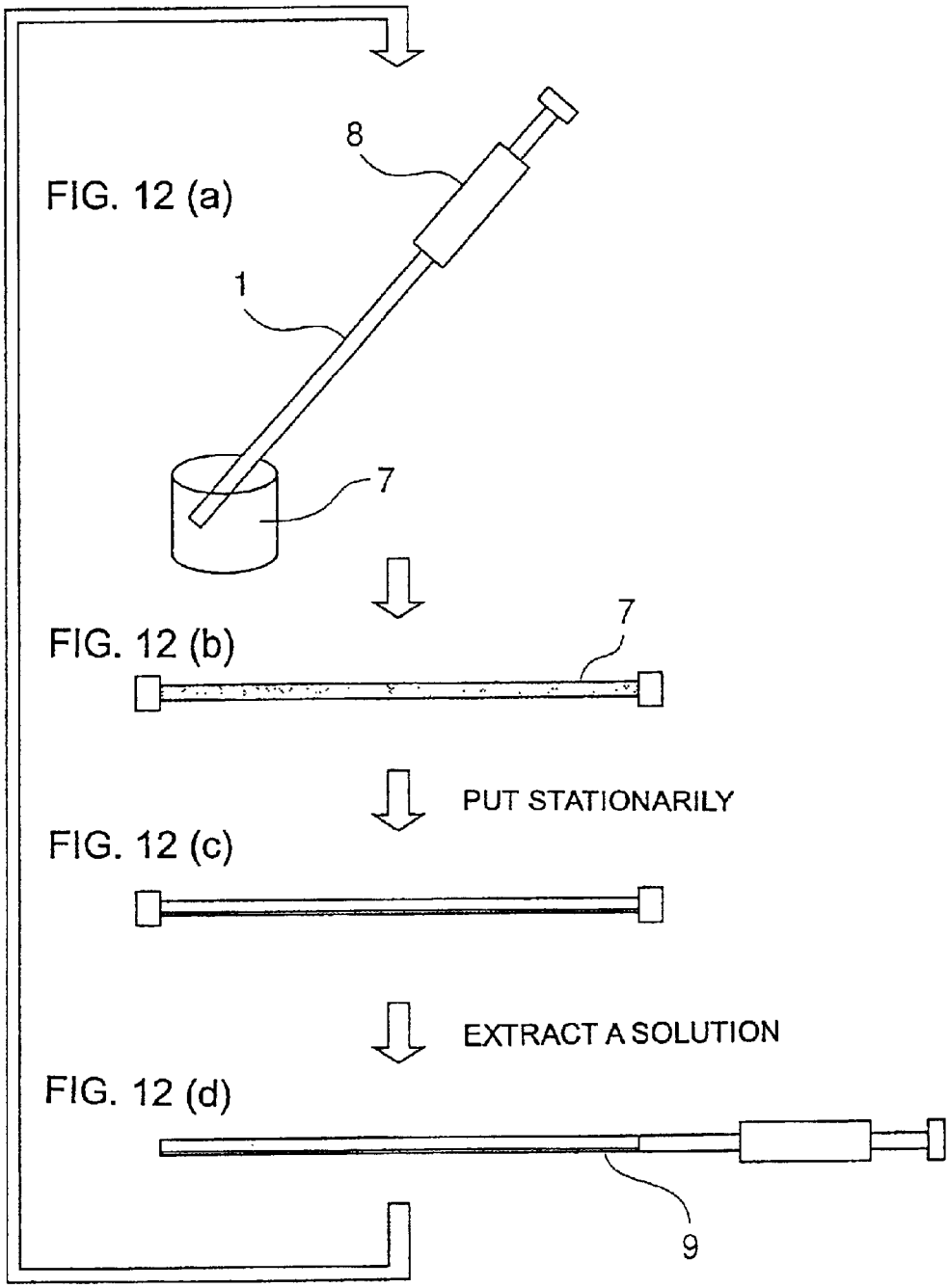

FIGS. 12(*a*) to 12(*d*) are views illustrating an embodiment in which a phosphor layer is to be formed in a plurality of portions. In the same manner as in the method shown in FIGS. 5(*a*) to 5(*d*), the phosphor slurry 7 is introduced into the gas discharge tube 1 by using the syringe 8 (see FIG. 12(*a*)), the gas discharge tube 1 is stationarily put horizontally in a sideways state (see FIG. 12(*b*)), the phosphor powder and binding resin in the phosphor slurry 7 are sedimented and bound (see FIG. 12(*c*)), and the slurry dispersion liquid is extracted from the gas discharge tube 1 (see FIG. 12(*d*)). So far, the production steps are the same as those shown in FIGS. 5(*a*) to 5(*d*).

After the phosphor deposited layer 9 is thus formed on one side of the internal wall surface of the gas discharge tube 1, the phosphor slurry 7 is introduced into the gas discharge tube 1 again. The tube is rotated into a position different from that in the previous step. In other words, the gas discharge tube 1 is stationarily put horizontally in a sideways state in which a side of the internal wall surface of the gas discharge tube 1 different from the side which is the bottom in the previous step is set to the underside.

Consequently, another phosphor deposited layer is formed in the longitudinal direction on the different side in the internal wall surface of the gas discharge tube 1. In other words, two phosphor deposited layers are formed. After this method is repeated plural times to form an optional number of phosphor deposited layers, the phosphor deposited layers are fired to form phosphor layers in a plurality of portions. If the phosphor layers are formed by this method, a plurality of phosphor layers can be formed in optional portions on the internal wall surface of the gas discharge tube as shown in FIGS. 7 and 9.

In the steps described above, the composition of the phosphor slurry at and after a second time may be changed, for example, the amount of phosphor powder is increased, and consequently, it is possible to form phosphor layers having different thicknesses.

Figure 13:
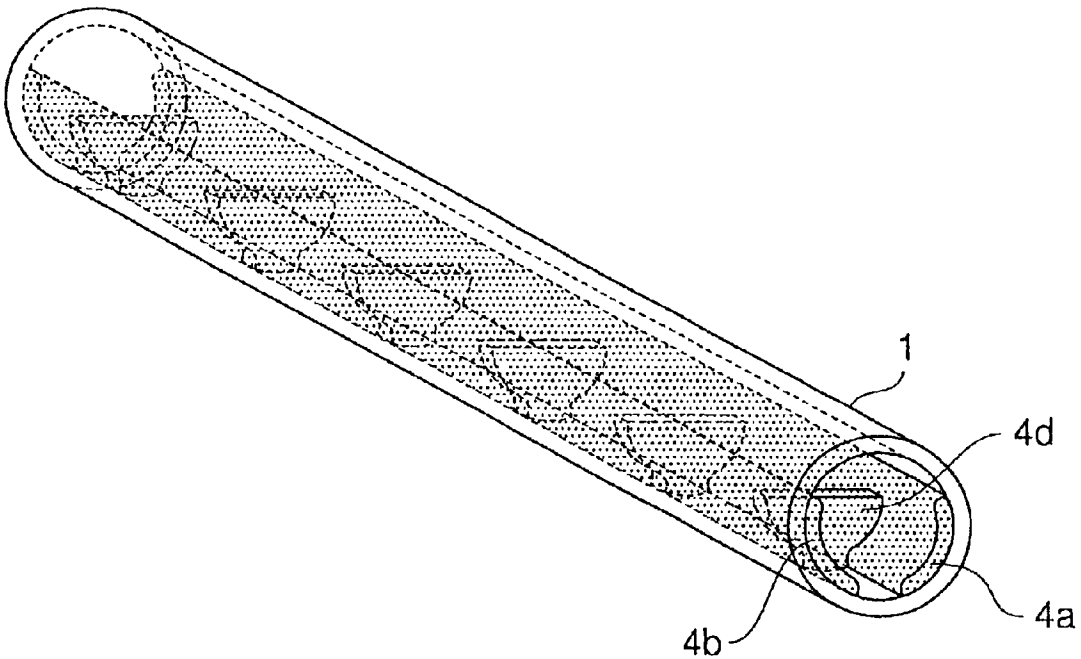
FIG. 13 is a view illustrating an example of the structure of a gas discharge tube in which convex phosphor layers are formed, FIGS. 14(*a*) to 14(*c*) are views illustrating an example of the structure of the gas discharge tube in which convex phosphor layers are formed.
Figure 14:
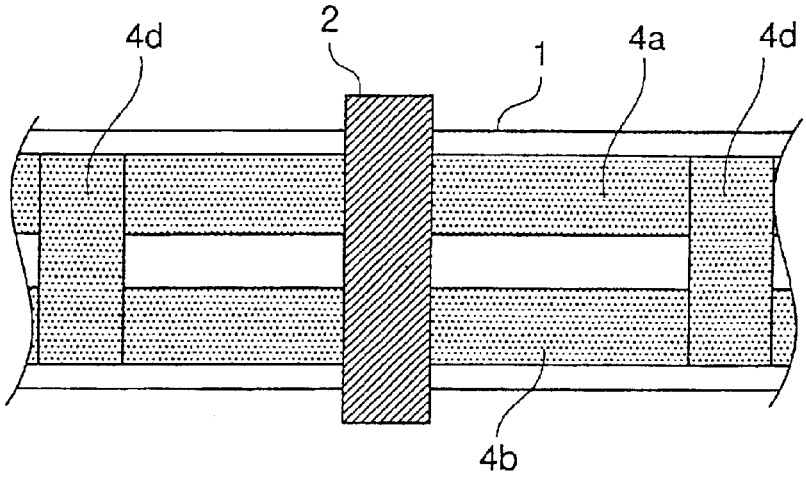
Figure 14:
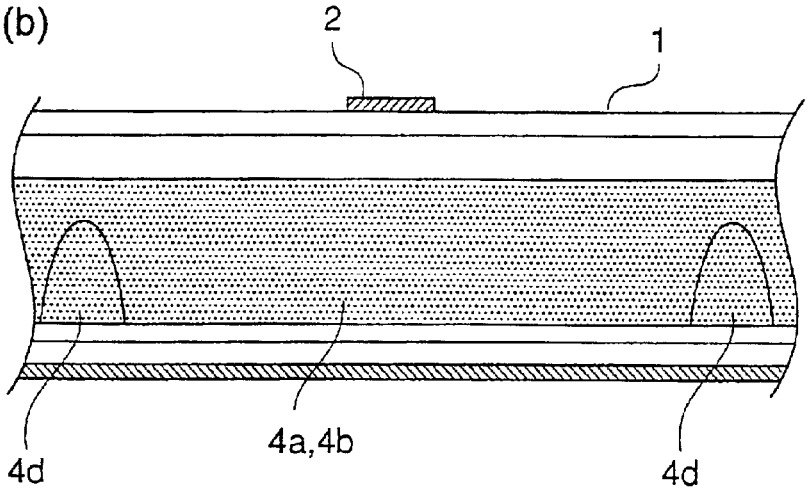
Figure 14C:
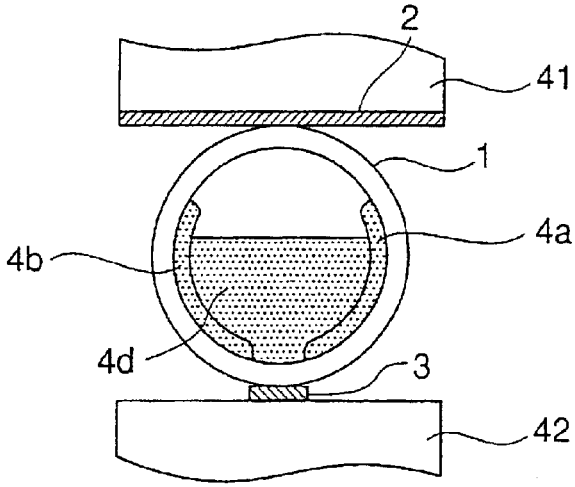

FIG. 13 and FIGS. 14(*a*) to 14(*c*) are views illustrating an example of the structure of a gas discharge tube having convex phosphor layers formed thereon. FIG. 14(*a*) shows a partial plane of the gas discharge tube in the vicinity of a display electrode, FIG. 14(*b*) shows a side view of the tube shown in FIG. 14(*a*), and FIG. 14(*c*) shows a section of the tube shown in FIG. 14(*b*).

In the figures, 4*d* denotes a convex phosphor layer. In the gas discharge tube 1, phosphor layers 4*a* and 4*b* are formed in two portions and the convex phosphor layers 4*d* are formed thereon. By thus forming the convex phosphor layer 4*d*, it is possible to convert vacuum ultraviolet rays, which would leak in the longitudinal direction of the tube, into visible light and thereby enhance the light emission efficiency.

Figure 15:
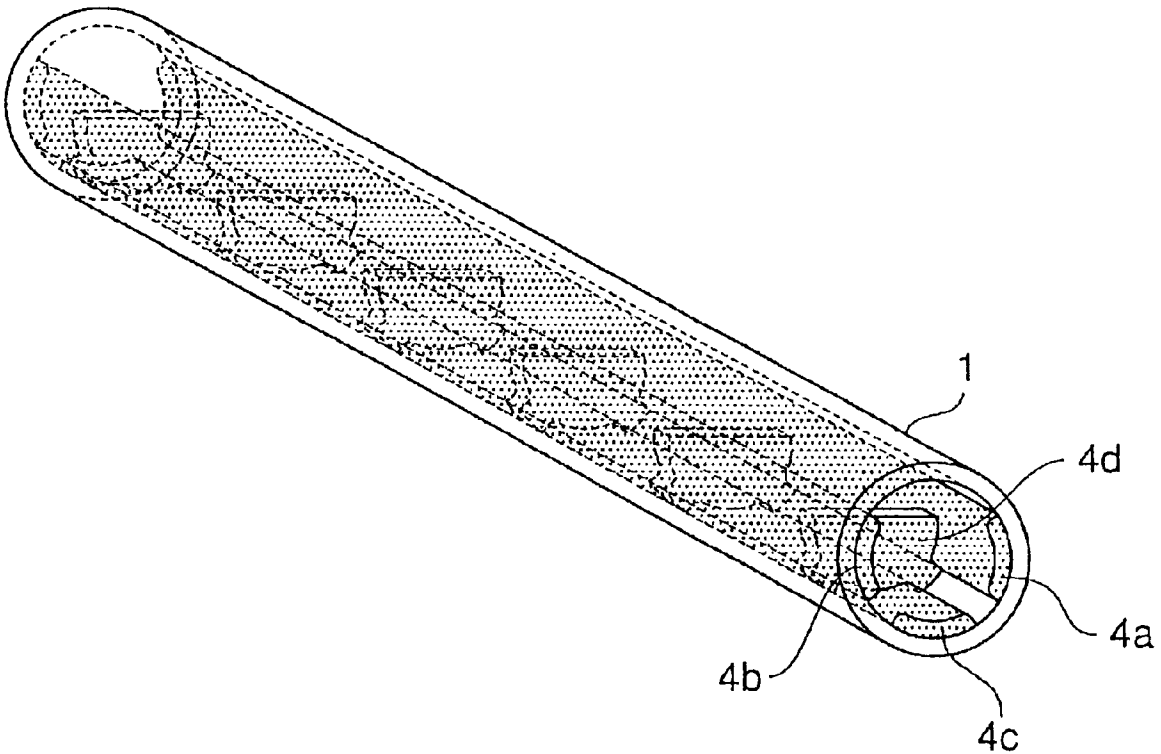
FIG. 15 is a view illustrating another example of the structure of the gas discharge tube in which convex phosphor layers are formed, FIGS. 16(*a*) to 16(*c*) are views illustrating another example of the structure of the gas discharge tube in which convex phosphor layers are formed, FIGS. 17(*a*) to 17(*c*) are views illustrating the structure of a gas discharge tube in which convex phosphor layers are formed on an electrode side.
Figure 16:
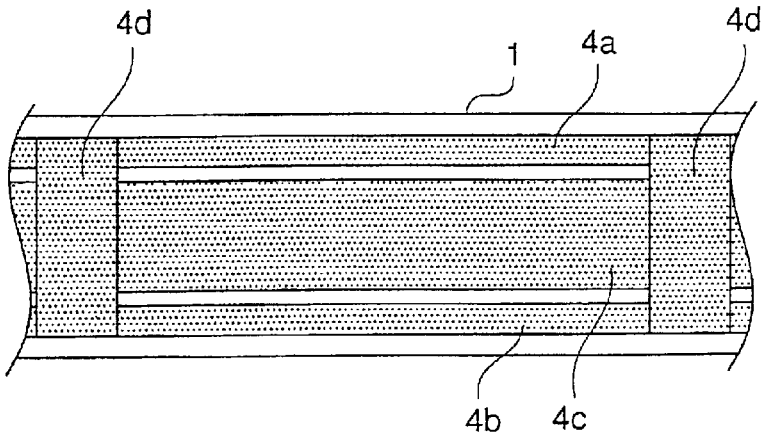
Figure 16:
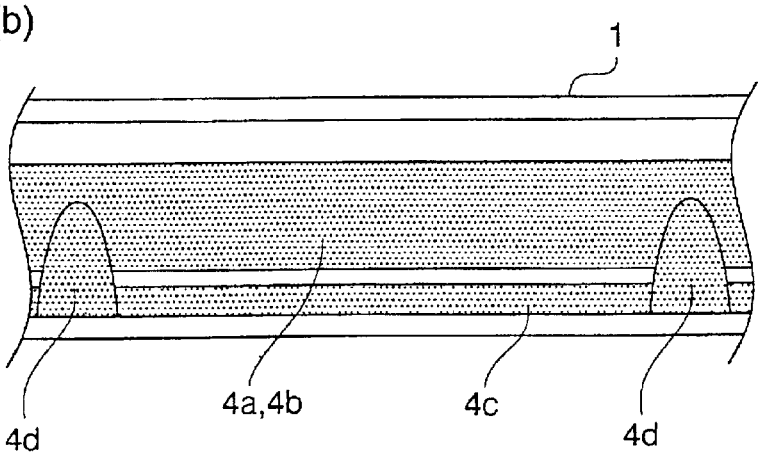
Figure 16:
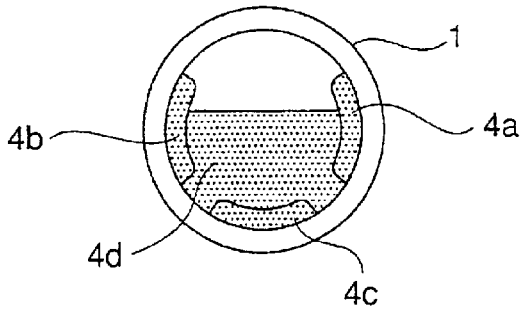

FIG. 15 and FIGS. 16(*a*) to 16(*c*) are views illustrating another example of the structure of the gas discharge tube having convex phosphor layers formed. FIG. 16(*a*) shows a partial plan view, FIG. 16(*b*) shows a side view of the tube shown in FIG. 16(*a*), and FIG. 16(*c*) shows a section of the tube shown in FIG. 16(*b*).

The gas discharge tube has phosphor layers 4*a*, 4*b* and 4*c* in three portions and convex phosphor layers 4*d* thereon. Thus, the phosphor layers 4*a*, 4*b* and 4c can be formed in the three portions and the convex phosphor layers 4*d* can be formed thereon.

Figure 17:
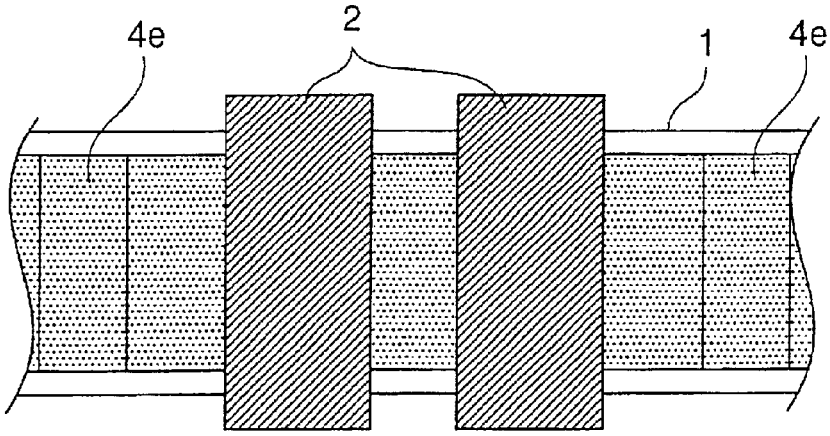
Figure 17:
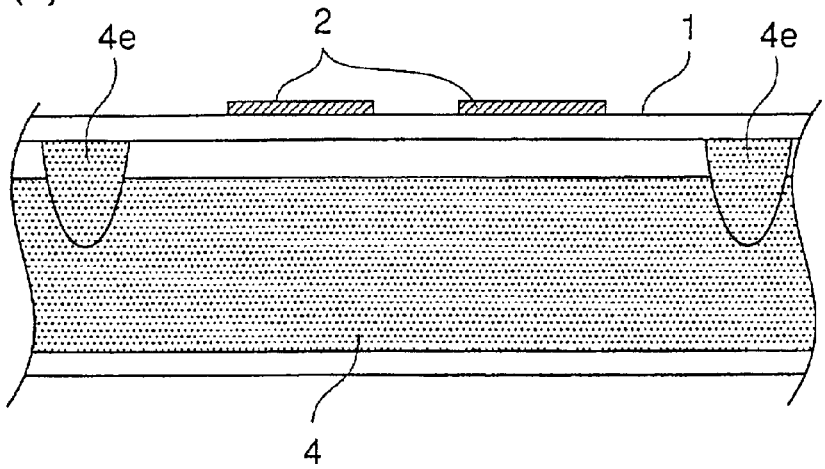
Figure 17:
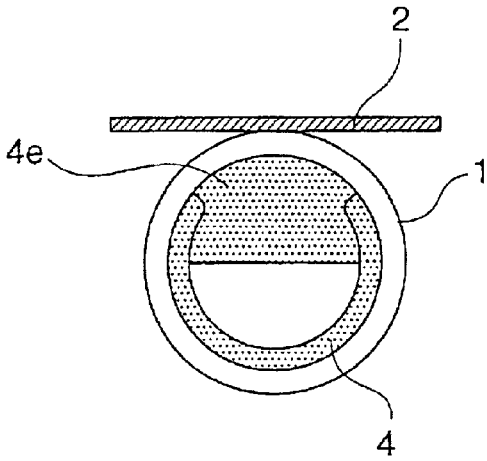

FIGS. 17(*a*) to 17(*c*) are views illustrating the structure of a gas discharge tube in which convex phosphor layers are formed on the electrode side. FIG. 17(*a*) shows a partial plan view in the vicinity of a display electrode, FIG. 17(*b*) shows a side view of the gas discharge tube shown in FIG. 17(*a*), and FIG. 17(*c*) shows a section of the gas discharge tube shown in FIG. 17(*b*).

Figure 18:
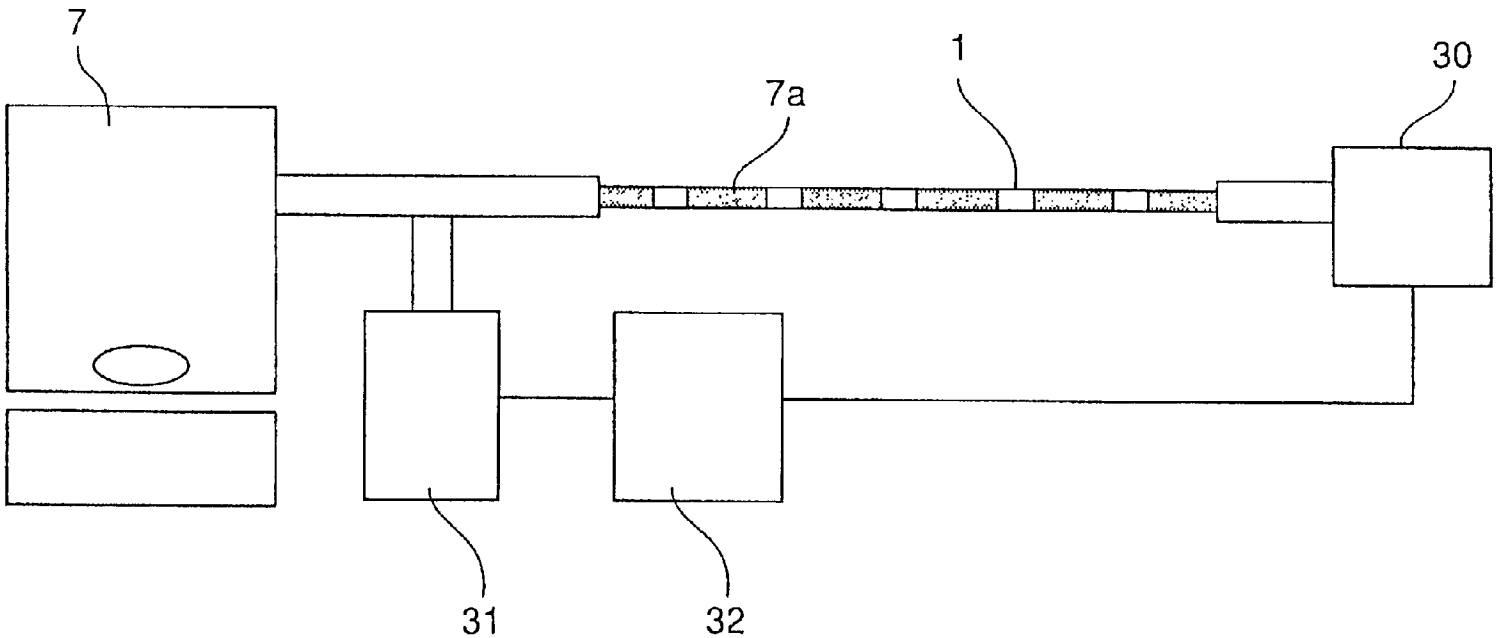
FIG. 18 is a view illustrating a method of forming convex phosphor layers.

In the figures, 4*e* denotes a convex phosphor layer provided on the electrode side. A gas discharge tube 1 is of such a type that a display electrode pair 2 is provided on one side of the tube. Vacuum ultraviolet rays are generated in the vicinity of the display electrode pair 2 of the gas discharge tube. Accordingly, the convex phosphor layers 4*e* thus formed on the display electrode pair 2 side of the gas discharge tube 1 provides a gas discharge tube having a high light emission efficiency;

FIG. 18 is a view illustrating a method of forming convex phosphor layers. In FIG. 18, the reference numerals 30 and 31 denote pumps and the reference numeral 32 denotes a control unit for controlling the pumps 30 and 31.

First of all, a phosphor slurry 7 is introduced into the gas discharge tube 1 by using the pump 30. The same phosphor slurry 7 as that shown in FIG. 5 is used. When a small amount of the phosphor slurry 7 is introduced, the control unit 32 carries out control to introduce a constant amount of air from the pump 31 into the gas discharge tube 1. By repeating this operation, a plurality of regular pools 7*a* of the phosphor slurry is formed in the gas discharge tube 1.

In the same manner as in FIGS. 5(*a*) to 5(*d*), then, the gas discharge tube 1 is stationarily put horizontally in a sideways state and the phosphor powder and the binding resin are sedimented and bound with the wall of the tube. Thereafter, the slurry dispersion solution is removed to partially form a phosphor deposited layer, which is then burnt. Thus, a convex phosphor layer is obtained. If a phosphor deposited layer is uniformly formed on the inner wall of the tube in the longitudinal direction before the partial phosphor deposited layer is formed, the phosphor layer can be formed to cover the whole light emission portion.

While only the formation of the phosphor layer has been described in the above method, an electron emission layer can be formed at the same time.

In the case where the electron emission layer is to be formed at the same time, an organometallic compound to be the electron emission layer by burning is used. A coating solution containing the organometallic compound is prepared, is introduced into the gas discharge tube, and is coated over the whole internal wall surface of the gas discharge tube and is then dried.

Thereafter, a phosphor slurry dispersion solution in which a coating layer of the organometallic compound is not dissolved is selected and a phosphor deposited layer is formed in the gas discharge tube with the phosphor slurry using the dispersion solution by any method described above. Consequently, the coating layer of the organometallic compound can be prevented from being damaged by the phosphor slurry.

After the phosphor deposited layer is formed, the coating layer of the organometallic compound and the phosphor deposited layer are burnt out at the same time to form the electron emission layer and the phosphor layer.

Although the coating layer for forming the electron emission layer is formed and the phosphor deposited layer is then formed in the above method, the process may be carried out in reverse order.

By using the phosphor slurry, first, the phosphor deposited layer is formed in the gas discharge tube by any method described above and is burnt out. Thus, the phosphor layer is formed.

Then, the coating solution of the organometallic compound is introduced into the gas discharge tube, and is coated over the internal wall surface of the gas discharge tube and is dried. When the coating solution of the organometallic compound is introduced into the gas discharge tube, the phosphor layer repels the solution. Therefore, the coating solution of the organometallic compound is rarely coated over the phosphor layer.

The coating layer of the organometallic compound is formed and is then burnt out. The electron emission layer is apt to be influenced by a pollution gas. By this method, however, the coating layer is not burnt out together with a resin component in the phosphor slurry. Therefore, the discharge characteristic of the electron emission layer is not deteriorated.

EXAMPLE

In the present example, the phosphor layer shown in FIG. 3 and FIGS. 4(*a*) and 4(*b*) was formed. First of all, 16 parts of phosphor powder, 2 parts of polyvinyl alcohol (a mean degree of polymerization of 2800), 6 parts of pure water, 23 parts of acetone and 53 parts of 1,3-dimethyl-2-imidazolidinone were used for the phosphor slurry.

The phosphor slurry was introduced into a tubular vessel formed of borosilicate glass having an outside diameter of 1 mm and an inside diameter of 0.8 mm in which MgO is uniformly formed on an internal wall surface. In the introduction, a solution (a low-viscosity solvent) containing 23 parts of acetone and 23 parts of 1,3-dimethyl-2-imidazolidinone was added to a solution containing 16 parts of phosphor powder, 2 parts of polyvinyl alcohol (a binding resin), 6 parts of pure water and 30 parts of 1,3-dimethyl-2-imidazolidinone immediately before the introduction. The tubular vessel is stationarily put horizontally in a sideways state so that the phosphor powder and the polyvinyl alcohol are sedimented and bound with the internal wall surface of the tubular vessel.

Then, an unnecessary dispersion solution was discharged and a slurry dispersion solution remaining on the internal wall surface of the tubular vessel was extracted and removed with acetone. Consequently, a phosphor deposited layer was formed on one side of the internal surface of the tubular vessel.

Thereafter, the phosphor deposited layer was burnt out to remove a resin component. Thus, a phosphor layer having a thickness of approximately 20 $\mu$m and taking a shape shown in FIG. 3 and FIGS. 4(*a*) and 4(*b*) was formed. Subsequently, a rare gas of Ne+Xe (4%) was introduced into the tubular vessel at a pressure of 350 Torr and the tubular vessel was sealed. Thereby a gas discharge tube was fabricated.

An electrode was arranged on the side of this gas discharge tube where the phosphor layer of the gas discharge tube is not formed, and a discharge was generated. Since the phosphor layer was not present in a discharge light emission region, visible light emitted from the phosphor layer in the gas discharge tube was able to be efficiently taken out.

In a display device using gas discharge tubes whose phosphor layers are so formed that the phosphor layers do not exist at least on the main electrodes by two or more continuous sedimentations using the phosphor slurry composition, as described above, the phosphor layers are not directly exposed to the discharge. For this reason, the phosphor layers are less deteriorated, the lifetime of the gas discharge tubes can be increased and the discharge characteristics can be stabilized.

By forming the electron emission layer having a great secondary electron emission coefficient on at least the main electrodes, moreover, the breakdown voltage can be dropped and the discharge characteristics can be improved.

By forming the convex phosphor layers in such a direction as to divide the discharge tube for each region in which light emission is defined by at least a pair of electrodes, furthermore, the effective utilization rate of vacuum ultraviolet rays generated by the discharge can be increased. In the display device using the gas discharge tube, consequently, the luminance can be increased and the light emission efficiency can be enhanced. Thus, it is possible to display images of high quality in which a light emission region for each electrode pair is defined more definitely.

According to the present invention, the phosphor layer can be formed on one side of the internal surface of the elongated gas discharge tube. Therefore, it is possible to implement a high light emission efficiency, low voltage driving and long lifetime of a display device using the gas discharge tube. Moreover, in the case where a convex phosphor layer is formed to surround a light emission point defined for each electrode, the light emission efficiency of the display device using the gas discharge tube can be increased, a region of a light emission portion can be defined definitely and image quality can be enhanced.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method of forming a phosphor layer of a gas discharge tube provided with the phosphor layer on an internal surface of an elongated tubular vessel forming a discharge space, comprising:

introducing a slurry of a phosphor powder and a binding resin dispersed in a medium into the tubular vessel;

holding the tubular vessel horizontally, in a sideways state, to deposit the phosphor powder and the binding resin in the tubular vessel; and removing the medium from the tubular vessel, thereby forming a phosphor layer on a portion of the internal surface of the tubular vessel.

2. The method of claim 1, wherein the binding resin is in a dispersion state in a dispersion medium when added to the medium.

3. The method of claim 2, wherein the binding resin comprises polyvinyl alcohol and the dispersion medium comprises water.

4. The method of claim 1, further comprising adding, to the slurry, a first solvent having a low viscosity for promoting the deposition of the phosphor powder and the binding resin immediately before introducing the slurry into the tubular vessel.

5. The method of claim 1, further comprising, after removing the medium from the tubular vessel, passing through an inside of the tubular vessel a second solvent having a low viscosity which does not dissolve the binding resin but dissolves the medium, thereby removing the medium remaining in the tubular vessel.

6. The method of claim 4, wherein the first solvents having a low viscosity comprises acetone or isopropyl alcohol.

7. The method of claim 1, wherein a plurality of phosphor layers are formed on one portion of the internal surface of the tubular vessel by repeating, plural times, the introducing the slurry having the phosphor powder and the binding resin dispersed in the medium into the tubular vessel, the holding the tubular vessel sideways to deposit the phosphor powder and the binding resin in the tubular vessel and then removing the medium from the tubular vessel.

8. The method of claim 7, wherein when repeating, plural times, the introducing the slurry having phosphor powder and the binding resin dispersed in the medium into the tubular vessel, the holding the tubular vessel sideways to deposit the phosphor powder and the binding resin in the tubular vessel and the removing the medium from the tubular vessel, the amount of the phosphor powder in the slurry is so changed that a plurality of phosphor layers having different thicknesses are formed on a portion of the internal surface of the tubular vessel.

9. The method of claim 1, wherein the slurry is introduced into the tubular vessel in a specific amount such that a convex phosphor layer is formed in the tubular vessel.

10. The method of claim 1, wherein, when introducing the slurry into the tubular vessel, air is introduced at regular intervals such that a plurality of convex phosphor layers are formed in the tubular vessel.

11. The method of claim 5, wherein the second solvent having a low viscosity comprises acetone or isopropyl alcohol.

12. A method of forming a phosphor layer of a gas discharge tube provided with the phosphor layer on an internal surface of an elongated tubular vessel forming a discharge space, comprising:

introducing a slurry of a phosphor powder and a binding resin, emulsionized in a medium, into the tubular vessel;

holding the tubular vessel sideways to deposit the phosphor power and the binding resin in the tubular vessel; and removing the medium from the tubular vessel, thereby forming a phosphor layer on a portion of the internal surface of the tubular vessel.

13. The method of claim 12, further comprising adding, to the slurry, a first solvent having a low viscosity for promoting the deposition of the phosphor powder and the binding resin immediately before introducing the slurry into the tubular vessel.

14. The method of claim 12, further comprising, after removing the medium from the tubular vessel, passing through an inside of the tubular vessel a second solvent having a low viscosity which does not dissolve the binding resin but dissolves the medium, thereby removing the medium remaining in the tubular vessel.

15. The method of claim 13, wherein the first solvent having a low viscosity comprises acetone or isopropyl alcohol.

16. The method of claim 14, wherein the second solvent having a low viscosity comprises acetone or isopropyl alcohol.

* * * * *

UNITED STATES PATENT AND TRADEMARK OFFICE

CERTIFICATE OF CORRECTION

PATENT NO. : 6,857,923 B2
DATED : February 22, 2005
INVENTOR(S) : Hitoshi Yamada et al.

It is certified that error appears in the above-identified patent and that said Letters Patent is hereby corrected as shown below:

Column 12,
Line 46, change “solvents” to -- solvent --.

Column 13,
Line 16, change “power” to -- powder --.

Signed and Sealed this

Sixteenth Day of August, 2005

JON W. DUDAS
*Director of the United States Patent and Trademark Office*